US007765971B1

(12) United States Patent
Overacker

(10) Patent No.: US 7,765,971 B1
(45) Date of Patent: Aug. 3, 2010

(54) VALVE COVER SYSTEM

(76) Inventor: Bernard S. Overacker, 57449 Kingdon Dr., Mattawan, MI (US) 49071

( * ) Notice: Subject to any disclaimer, the term of this patent is extended or adjusted under 35 U.S.C. 154(b) by 377 days.

(21) Appl. No.: 11/971,696

(22) Filed: Jan. 9, 2008

(51) Int. Cl.
*F01M 9/10* (2006.01)

(52) U.S. Cl. ..... 123/90.38; 123/90.39; 123/193.5; 123/195 C; 74/559

(58) Field of Classification Search ..... 123/90.16, 123/90.27, 90.31, 90.39, 90.38, 90.44, 193.3, 123/193.5, 195 C, 198 E, 198 F; 29/888.2; 74/559, 567, 569
See application file for complete search history.

(56) References Cited

U.S. PATENT DOCUMENTS

| | | | | |
|---|---|---|---|---|
| 3,396,712 | A | 8/1968 | Sakraida et al. | |
| 4,788,950 | A | 12/1988 | Finley | |
| D324,867 | S | 3/1992 | Lyndhurst et al. | |
| 5,598,612 | A | 2/1997 | Sheldon | |
| 5,899,182 | A | 5/1999 | Martinsson et al. | |
| 6,491,014 | B1 | 12/2002 | Eickert | |
| 6,712,405 | B2 | 3/2004 | Desmarais et al. | |
| 6,863,039 | B2 | 3/2005 | Salameh | |
| 7,316,215 | B1 * | 1/2008 | Nino et al. | 123/90.38 |

* cited by examiner

*Primary Examiner*—Ching Chang

(57) ABSTRACT

A valve cover system for covering valves, rocker arms and a cam shaft of an engine includes a mounting plate being mounted to a cylinder head of the engine. The mounting plate has an access aperture extending through a top surface and a bottom surface of the mounting plate. The access aperture permits the valves, the rocker arms and the cam shaft to extend through the mounting plate when the mounting plate is mounted to the cylinder head. A plurality of securing assemblies is coupled to the mounting plate and upwardly extending therefrom. A cover is mounted to the mounting plate to cover the access aperture and inhibits debris from entering the valves, the rocker arms and the cam shaft. A pair of latch assemblies is operationally coupled to the cover. The latch assemblies receive the securing assemblies to secure the cover to the mounting plate.

17 Claims, 8 Drawing Sheets

VALVE COVER SYSTEM

BACKGROUND OF THE INVENTION

1. Field of the Invention

The present invention relates to case covers and more particularly pertains to a new case cover for covering valves, rocker arms and a cam shaft of an engine.

2. Description of the Prior Art

The use of case covers is known in the prior art. While these devices fulfill their respective, particular objectives and requirements, the need remains for a system that has certain improved features that allows for a cover of the system to be readily removed and replaced on a cylinder head when work is be performed on the valves, the rocker arms or the cam. Additionally, the system should include a plurality of oil shields that deflect oil from the cover to inhibit the oil leaking out of the system.

SUMMARY OF THE INVENTION

The present invention meets the needs presented above by generally comprising a mounting plate being mounted to a cylinder head of an engine. The mounting plate has an access aperture extending through a top surface and a bottom surface of the mounting plate. The access aperture permits valves, rocker arms and a cam shaft to extend through the mounting plate when the mounting plate is mounted to the cylinder head. A plurality of securing A plurality of securing assemblies is coupled to the mounting plate and upwardly extending therefrom. Each of a pair of opposing ends of the mounting plate have a pair of the securing assemblies is positioned adjacent thereto. A cover is mounted to the mounting plate to cover the access aperture and inhibits debris from entering the valves, the rocker arms and the cam shaft. A pair of latch assemblies is operationally coupled to the cover. The latch assemblies receive the securing assemblies to secure the cover to the mounting plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
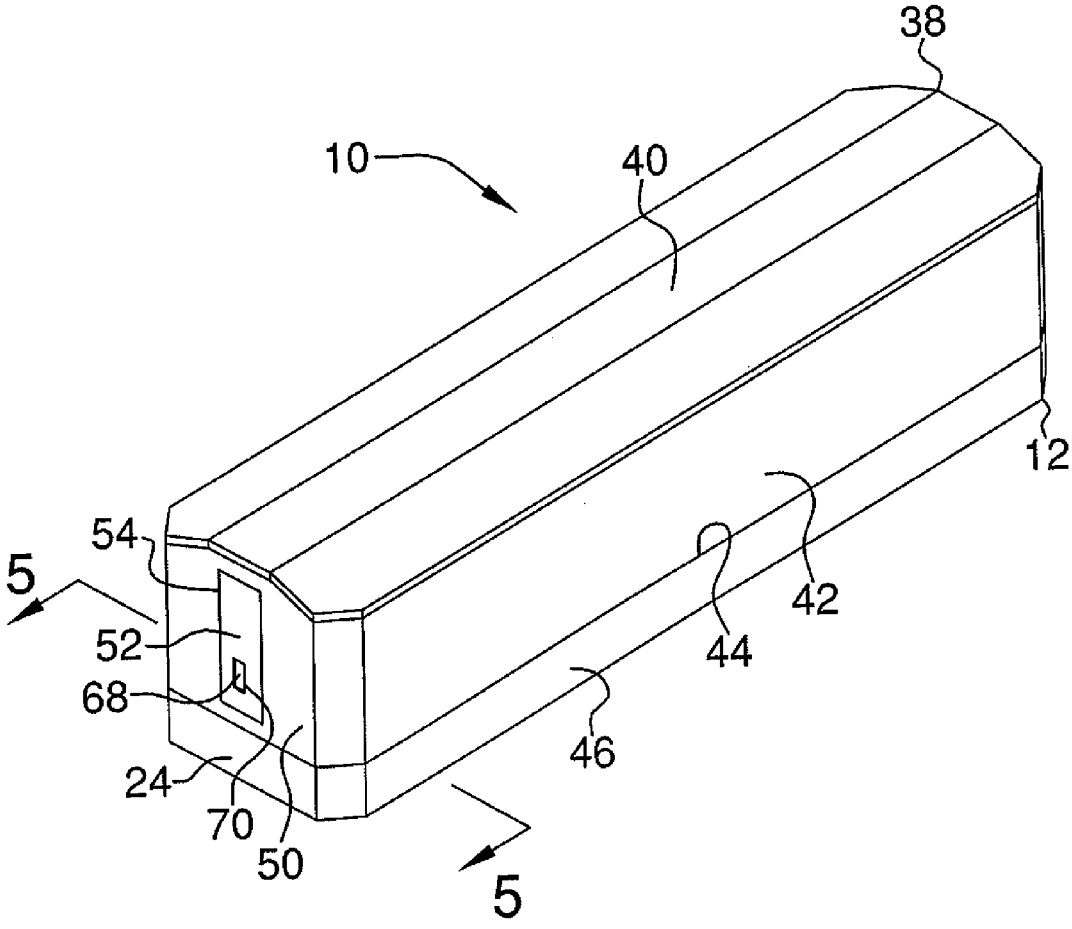
FIG. 1 is a perspective view of a valve cover system according to the present invention.
Figure 2:
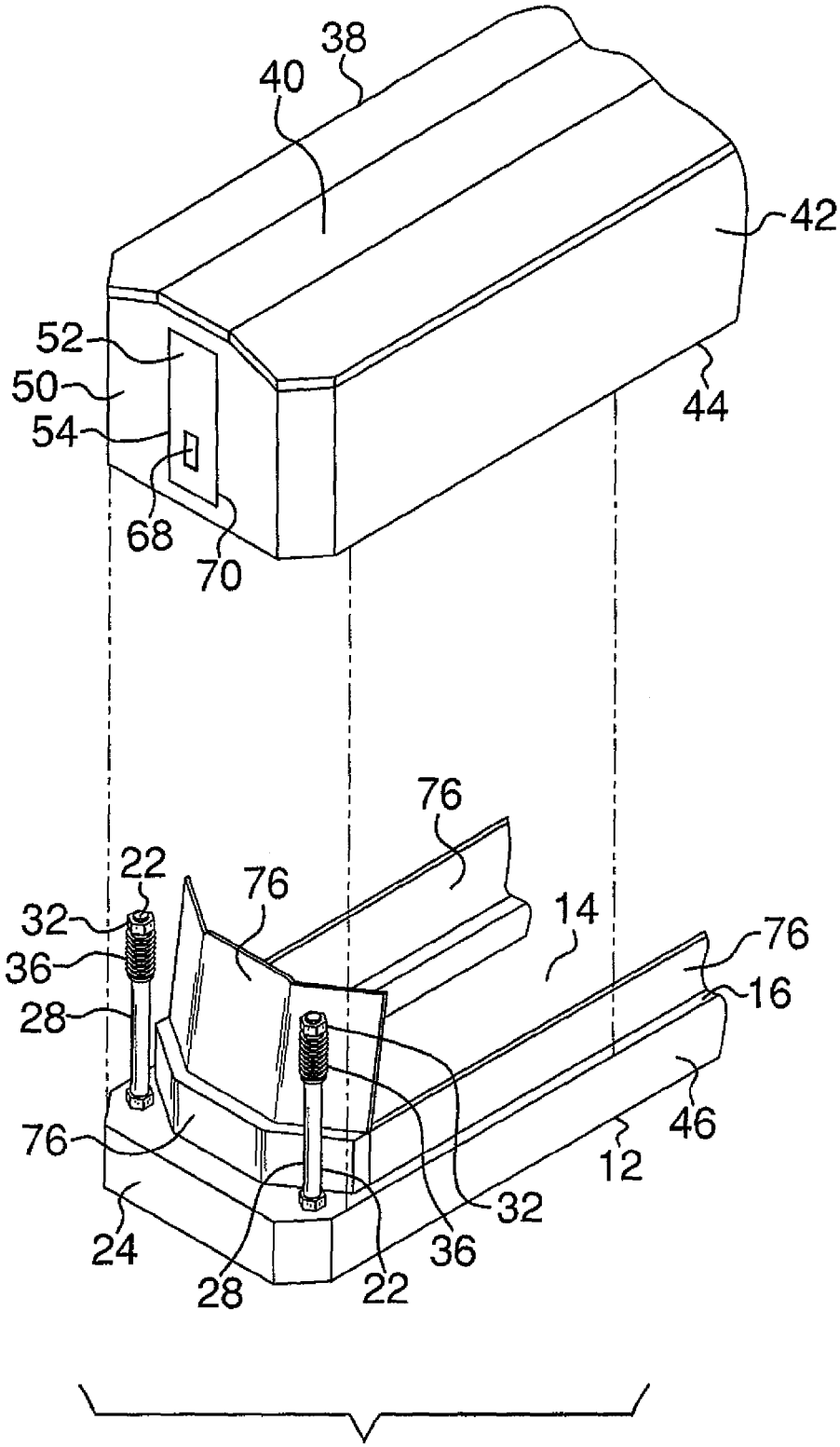
FIG. 2 is an exploded perspective view of the present invention.
Figure 3:
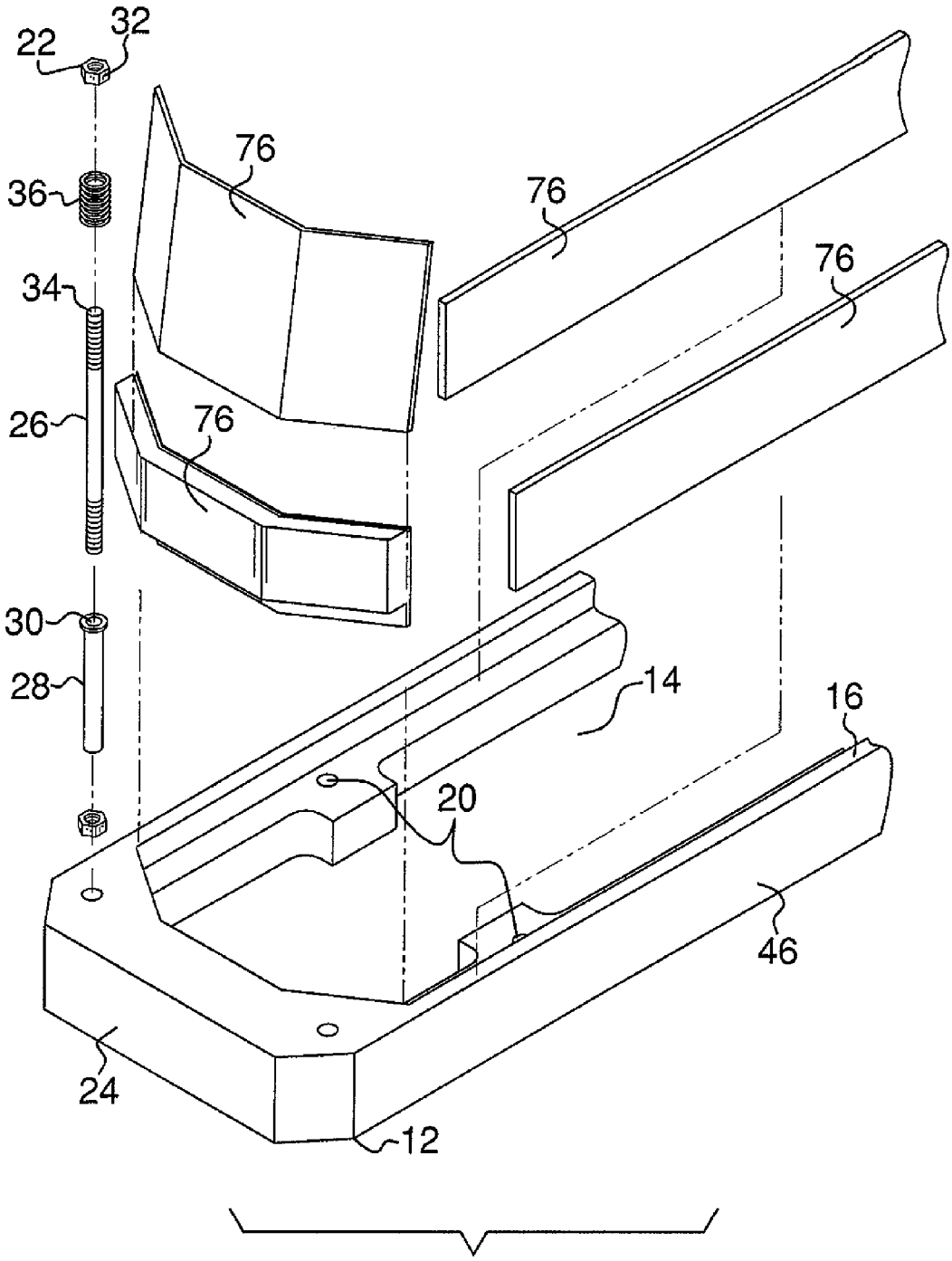
FIG. 3 is an enlarged perspective view of the oil plates, mounting plate and securing assemblies of the present invention.
Figure 4:
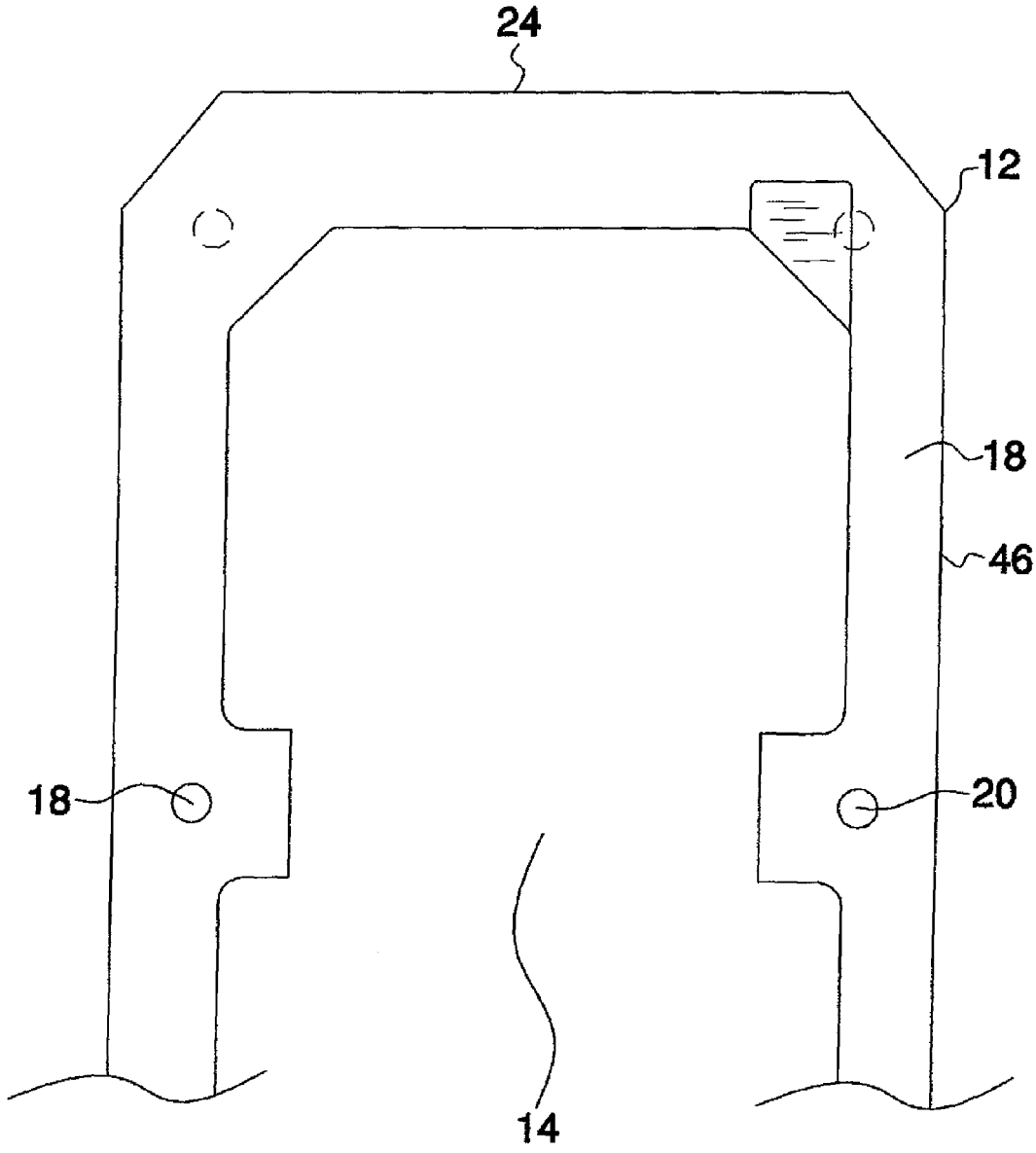
FIG. 4 is a bottom view of a portion of the mounting plate of the present invention.
Figure 5:
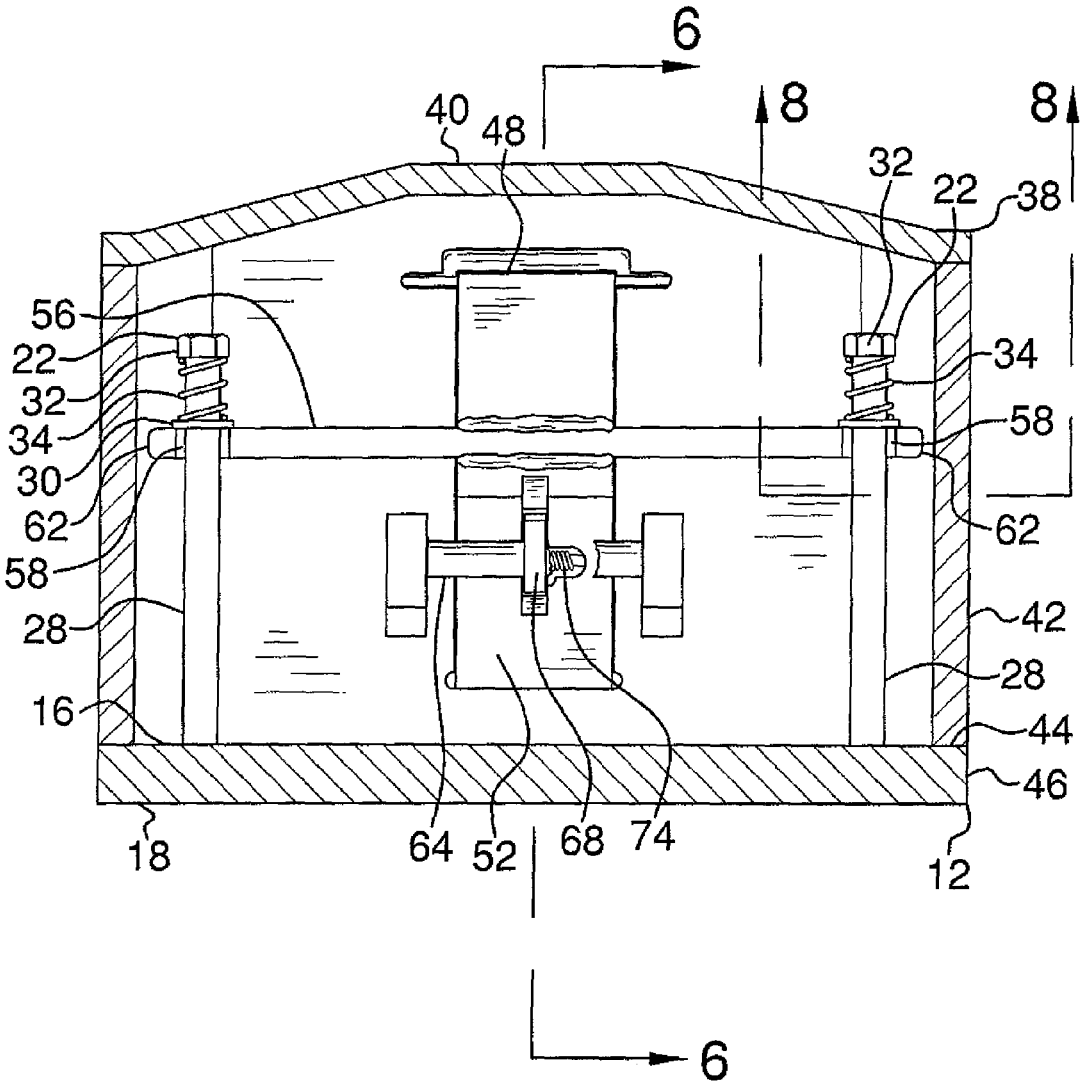
FIG. 5 is a cross-sectional view of the present invention taken along line 5-5 of FIG. 1.
Figure 6:
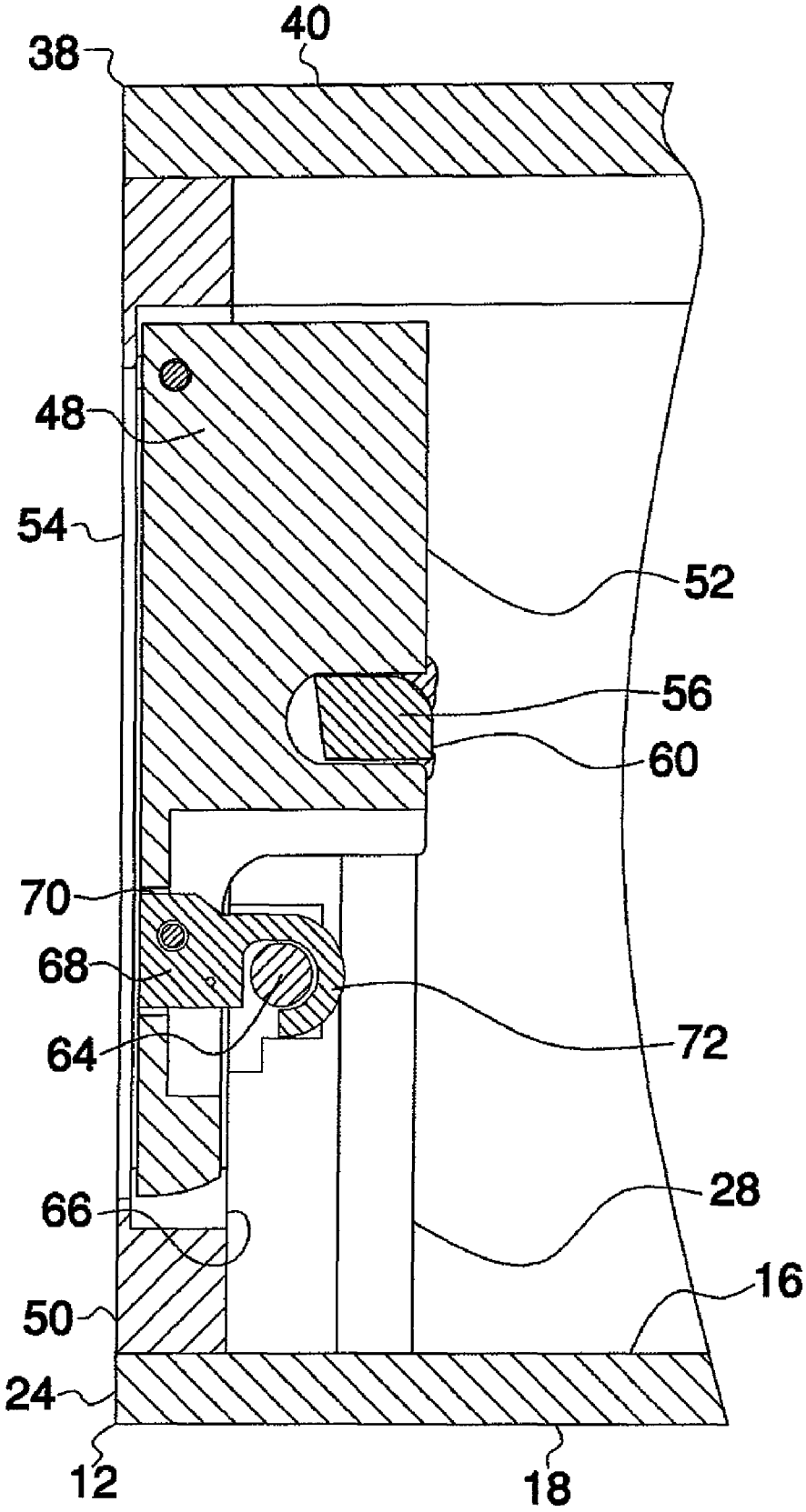
FIG. 6 is a cross-sectional view of the present invention taken along line 6-6 of FIG. 5.
Figure 7:
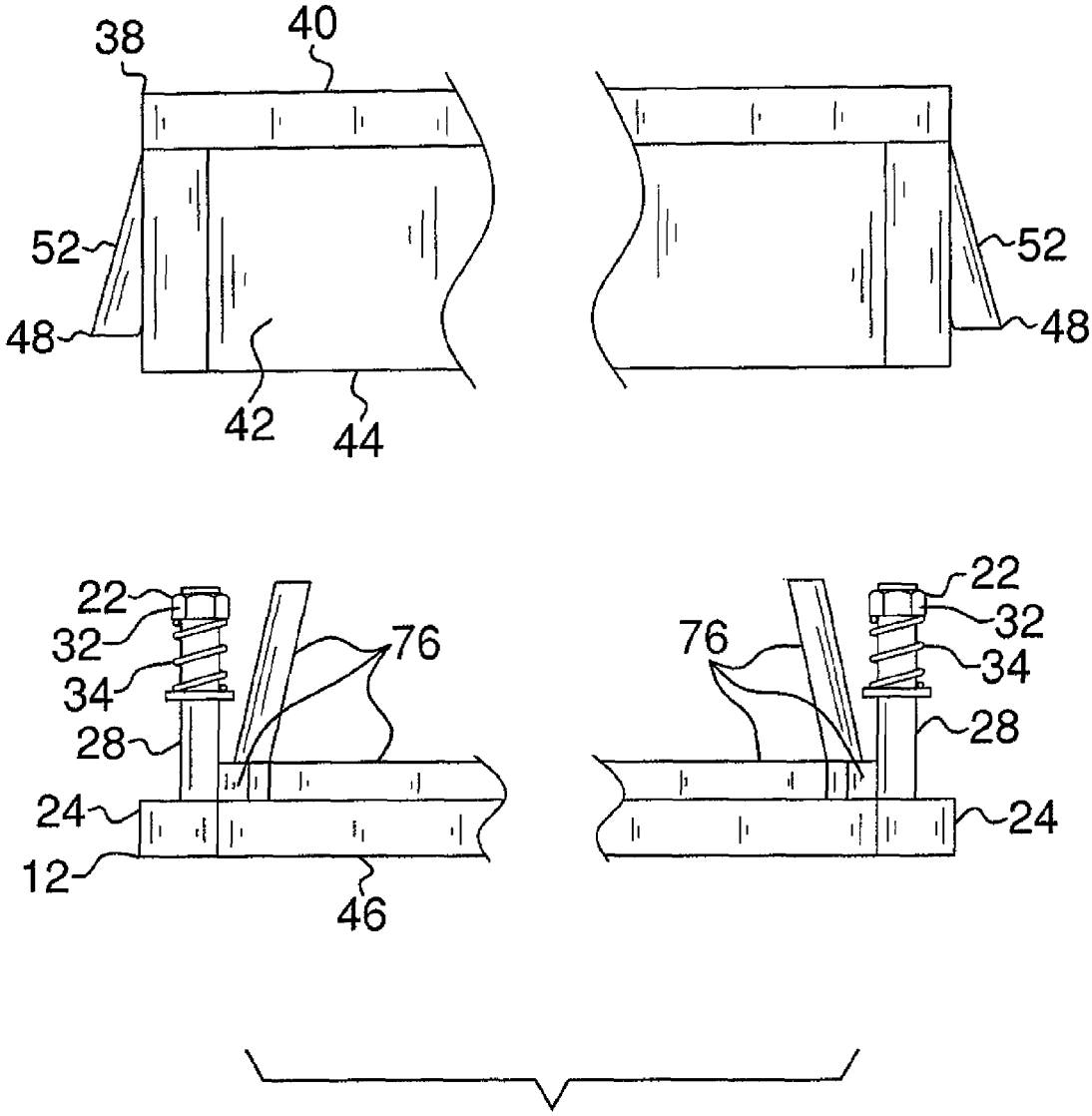
FIG. 7 is an exploded side view of the present invention.
Figure 8:
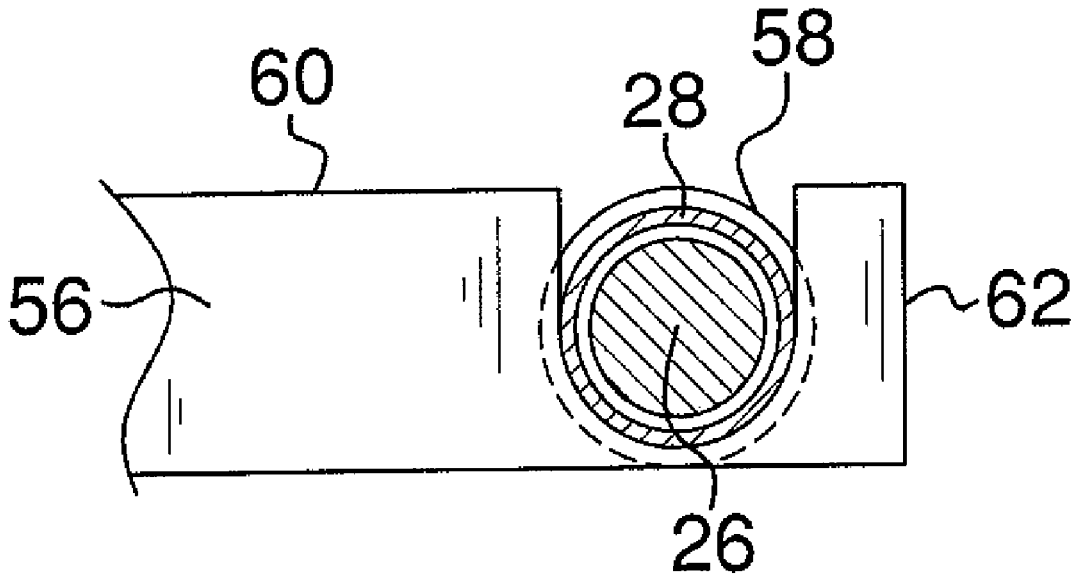
FIG. 8 is a cross-sectional view of the present invention taken along line 8-8 of FIG. 6.

With reference now to the drawings, and in particular to FIGS. 1 through 8 thereof, a new case cover embodying the principles and concepts of the present invention and generally designated by the reference numeral 10 will be described.

As best illustrated in FIGS. 1 through 8, the valve cover system 10 generally comprises a mounting plate 12 being mounted to a cylinder head of an engine. The mounting plate 12 has an access aperture 14 extending through a top surface 16 and a bottom surface 18 of the mounting plate 12. The access aperture 14 permits valves, rocker arms and a cam shaft to extend through the mounting plate 12 when the mounting plate 12 is mounted to the cylinder head. The mounting plate 12 has a plurality of mounting apertures 20 extending through the top surface 16 and the bottom surface 18 and is positioned adjacent the access aperture 14. Each of the mounting apertures 20 receives one of a mounting apertures 20 receives one of a plurality of fasteners to mount the mounting plate 12 to the cylinder head.

A plurality of securing assemblies 22 is coupled to the mounting plate 12 and upwardly extends therefrom. Each of a pair of opposing ends 24 of the mounting plate 12 has a pair of the securing assemblies 22 positioned adjacent thereto. Each of the securing assemblies 22 includes a support rod 26 coupled to the mounting plate 12 and extends upwardly from the mounting plate 12. A sleeve 28 is slidably positioned around the support rod 26. A top end 30 of the sleeve 28 is flanged. A retaining nut 32 is coupled to an upper end 34 of the support rod 26. A sleeve biasing member 36 extends between the retaining nut 32 and the top end 30 of the sleeve 28. The sleeve biasing member 36 biases the sleeve 28 away from the retaining nut 32.

A cover 38 is mounted to the mounting plate 12 to cover the access aperture 14 and inhibits debris from entering the valves, the rocker arms and the cam shaft. The cover 38 includes a top wall 40 and a peripheral wall 42 that extends downwardly from the top wall 40. A bottom edge 44 of the peripheral wall 42 abuts against and seals against the mounting plate 12 adjacent a perimeter edge 46 of the mounting plate 12 when the cover 38 is mounted to the mounting plate 12.

A pair of latch assemblies 48 is operationally coupled to the cover 38. The latch assemblies 48 receive the securing assemblies 22 to secure the cover 38 to the mounting plate 12. Each of a pair of end walls 50 of the peripheral wall 42 has one of the latch assemblies 48 operationally coupled thereto. Each of the latch assemblies 48 includes a latch lever 52 hingedly coupled to the associated one of the end walls 50. The latch lever 52 is pivoted outwardly through a latch slot 54 in the associated one of the end walls 50 when the latch of the end walls 50 when the latch assembly is disengaged from the securing assemblies 22.

Each of the latch assemblies 48 includes a latch bar 56 coupled to the latch lever 52 and is positioned orthogonally to the latch lever 52. The latch bar 56 has a pair of grooves 58 that extend through a rear edge 60 of the latch bar 56. Each of a pair of free ends 62 of the latch bar 56 has one of the grooves 58 positioned adjacent thereto. Each of the grooves 58 receives the sleeve 28 of one of the securing assemblies 22 and abuts against the top end 30 of the sleeve 28 to force the cover 38 against the mounting plate 12 when the latch lever 52 is pivoted into the latch slot 54.

Each of the latch assemblies 48 additionally includes a lock bar 64 coupled to an interior face 66 of an associated one of the end walls 50. The lock bar 64 extends across the latch slot 54. A lock lever 68 is hingedly coupled to the latch lever 52 and positioned in a lock slot 70 of the latch lever 52. The lock lever 68 includes a hook end. The hooked end 72 is extendable around a portion of the lock bar 64 to secure the latch lever 52 from inadvertently pivoting out of the latch slot 54 and disengaging the latch bar 56 from the securing assemblies 22. The hooked end 72 is disengaged from the lock bar 64 when the lock lever 68 is pivoted into the cover 38. A lock biasing member 74 is coupled between the lock lever 68 and the latch lever 52. The lock biasing member 74 biases the hooked end 72 of the lock lever 68 around the portion of the lock bar 64 when the lock lever 68 is not pivoted into the cover 38 and the latch lever 52 is positioned in the cover 38.

A plurality of oil plates 76 is mounted to the cover 38 and positioned adjacent the access aperture 14 when the cover 38 is in place. The oil plates 76 deflect oil sprayed up from the valves, the rocker arms and the cam shaft and the cam shaft away from the cover 38 and back towards the valves, the rocker arms and the cam shaft.

In use, the mounting plate 12 is mounted to the cylinder head. The cover 38 is positioned over the mounting plate 12. The latch lever 52 is pressed into the cover 38 to push the grooves 58 of the latch bar 56 around the sleeves 28 of the securing assemblies 22. As the latch lever 52 is pushed into the cover 38 the hooked end 72 of the lock lever 68 is forced over the lock bar 64 to secure the latch lever 52 from pivoting. To remove the cover 38 the lock lever 68 is pivoted into the cover 38 to disengage the hooked end 72 from the lock bar 64 and allow the latch lever 52 to be pivoted out of the cover 38 to disengage the latch bar 56 from the securing assemblies 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A valve cover system for covering valves, rocker arms and a cam shaft of an engine, said system comprising:

a mounting plate being mounted to a cylinder head of the engine, said mounting plate having an access aperture extending through a top surface and a bottom surface of said mounting plate, said access aperture permitting the valves, rocker arms and the cam shaft to extend through said mounting plate when said mounting plate is mounted to the cylinder head;

a plurality of securing assemblies being coupled to said mounting plate and upwardly extending therefrom, each of a pair of opposing ends of said mounting plate having a pair of said securing assemblies being positioned adjacent thereto;

a cover being mounted to said mounting plate to cover said access aperture and inhibit debris from entering the valves, the rocker arms and the cam shaft; and a pair of latch assemblies being operationally coupled to said cover, said latch assemblies receiving said securing assemblies to secure said cover to said mounting plate.

2. The system according to claim 1, wherein said mounting plate has a plurality of mounting apertures extending through said top surface and said bottom surface and being positioned adjacent said access aperture, each of said mounting apertures receiving one of a plurality of fasteners to mount said mounting plate to the cylinder head.

3. The system according to claim 1, wherein each of said securing securing assemblies includes a support rod being coupled to said mounting plate and extending upwardly from said mounting plate.

4. The system according to claim 3, wherein each of said securing assemblies includes a sleeve being slidably positioned around said support rod, a top end of said sleeve being flanged.

5. The system according to claim 4, wherein each of said securing assemblies includes a retaining nut being coupled to an upper end of said support rod.

6. The system according to claim 5, wherein each of said securing assemblies includes a sleeve biasing member extending between said retaining nut and said top end of said sleeve, said sleeve biasing member biasing said sleeve away from said retaining nut.

7. The system according to claim 4, wherein each of said latch assemblies includes a latch lever being hingedly coupled to one of a pair of end walls of said cover, said latch lever being pivoted outwardly through a latch slot in the associated one of said end walls when said latch assembly is disengaged from said securing assemblies.

8. The system according to claim 7, wherein each of said latch assemblies includes a latch bar being coupled to said latch lever and being positioned orthogonally to said latch lever.

9. The system according to claim 8, wherein said latch bar has a pair of grooves extending through a rear edge of said latch bar, each of a pair of free ends of said latch bar having one of said grooves positioned adjacent thereto, each of said grooves receiving said sleeve of one of said securing securing assemblies and abutting against said top end of said sleeve to force said cover against said mounting plate when said latch lever is pivoted into said latch slot.

10. The system according to claim 7, wherein each of said latch assemblies includes a lock bar being coupled to an interior face of an associated one of said end walls, said lock bar extending across said latch slot.

11. The system according to claim 10, wherein each of said latch assemblies includes a lock lever being hingedly coupled to said latch lever and positioned in a lock slot of said latch lever.

12. The system according to claim 11, wherein said lock lever includes a hook end, said hooked end being extendable around a portion of said lock bar to secure said latch lever from inadvertently pivoting out of said latch slot and disengaging said latch bar from said securing assemblies, said hooked end being disengaged from said lock bar when said lock lever is pivoted into said cover.

13. The system according to claim 11, wherein each of said latch assemblies includes a lock biasing member being coupled between said lock lever and said latch lever, said lock biasing member biasing said hooked end of said lock lever around the portion of said lock bar when said lock lever is not pivoted into said cover and said latch lever is positioned in said cover.

14. The system according to claim 1, wherein said cover includes a top wall and a peripheral wall extending downwardly from said top wall, a bottom edge of said peripheral wall abutting against and sealing against said mounting said mounting plate adjacent a perimeter edge of said mounting plate when said cover is mounted to said mounting plate.

15. The system according to claim 14, wherein each of a pair of end walls of said peripheral wall has one of said latch assemblies operationally coupled thereto.

16. The system according to claim 1, further comprising a plurality of oil plates being mounted to said cover adjacent said access aperture, said oil plates deflecting oil sprayed up from the valves, the rocker arms and the cam shaft away from said cover and back towards the valves, the rocker arms and the cam shaft.

17. A valve cover system for covering valves, rocker arms and a cam shaft of an engine, said system comprising:

a mounting plate being mounted to a cylinder head of the engine, said mounting plate having an access aperture extending through a top surface and a bottom surface of said mounting plate, said access aperture permitting the valves, rocker arms and the cam shaft to extend through said mounting plate when said mounting plate is mounted to the cylinder head, said mounting plate having a plurality of mounting apertures extending through said top surface and said bottom surface and being positioned adjacent said access aperture, each of said mounting apertures receiving one of a plurality of fasteners to mount said mounting plate to the cylinder head;

a plurality of securing assemblies being coupled to said mounting plate and upwardly extending therefrom, each of a pair of opposing ends of said mounting plate having a pair of said securing assemblies being positioned adjacent thereto, each of said securing assemblies said securing assemblies comprising;

a support rod being coupled to said mounting plate and extending upwardly from said mounting plate;

a sleeve being slidably positioned around said support rod, a top end of said sleeve being flanged;

a retaining nut being coupled to an upper end of said support rod;

a sleeve biasing member extending between said retaining nut and said top end of said sleeve, said sleeve biasing member biasing said sleeve away from said retaining nut;

a cover being mounted to said mounting plate to cover said access aperture and inhibit debris from entering the valves, the rocker arms and the cam shaft, said cover including a top wall and a peripheral wall extending downwardly from said top wall, a bottom edge of said peripheral wall abutting against and sealing against said mounting plate adjacent a perimeter edge of said mounting plate when said cover is mounted to said mounting plate;

a pair of latch assemblies being operationally coupled to said cover, said latch assemblies receiving said securing assemblies to secure said cover to said mounting plate, each of a pair of end walls of said peripheral wall having one of said latch assemblies operationally coupled thereto, each of said latch assemblies comprising;

a latch lever being hingedly coupled to the associated one of said end walls, said latch lever being pivoted outwardly through a latch slot in the associated one of said end walls when said latch assembly is disengaged from said securing assemblies;

a latch bar being coupled to said latch lever and being positioned orthogonally to said latch lever, said latch bar having a pair of grooves extending through a rear edge of said latch bar, each of a pair of free ends of said latch bar having one of said grooves positioned adjacent thereto, each of said grooves receiving said sleeve of one of said securing assemblies and abutting against said top end of said sleeve to force said cover against said mounting plate when said latch lever is pivoted into said latch slot;

a lock bar being coupled to an interior face of an associated one of said end walls, said lock bar extending across said latch slot;

a lock lever being hingedly coupled to said latch lever and positioned in a lock slot of said latch lever, said lock lever including a hook end, said hooked end being extendable around a portion of said lock bar to secure said latch lever from inadvertently pivoting out of said latch slot and disengaging said latch bar from said securing assemblies, said hooked end being disengaged from said lock bar when said lock lever is pivoted into said cover; and a lock biasing member being coupled between said lock lever and said latch lever, said lock biasing member biasing said hooked end of said lock lever around the portion of said lock bar when said lock lever is not pivoted into said cover and said latch lever is positioned in said cover.

* * * * *